US005386616A

United States Patent [19]

Norvell

[11] Patent Number: 5,386,616

[45] Date of Patent: Feb. 7, 1995

[54] WATER RESISTANT CLOSURE AND METHOD FOR APPLYING SAME

[75] Inventor: Jean Norvell, Newark, Del.

[73] Assignee: W. L. Gore & Associates, Inc., Newark, Del.

[21] Appl. No.: 44,518

[22] Filed: Apr. 8, 1993

[51] Int. Cl.[6] ..... A44B 19/00

[52] U.S. Cl. ..... 24/389; 24/384; 24/396

[58] Field of Search ..... 24/389, 394, 396, 384

[56] References Cited

U.S. PATENT DOCUMENTS

| | | | |
|---|---|---|---|
| 1,991,943 | 10/1933 | Keviczky . | |
| 2,371,776 | 2/1943 | Van Orman . | |
| 2,532,724 | 12/1947 | Krupp . | |
| 2,853,758 | 9/1958 | Topf . | |
| 3,490,109 | 1/1970 | Heimberger | 24/389 |
| 3,501,816 | 3/1970 | Heimberger | 24/389 |
| 3,668,745 | 6/1972 | Krupp | 24/389 |
| 4,275,467 | 6/1981 | Doelter . | |
| 4,461,098 | 7/1984 | Diegelman . | |
| 4,601,085 | 7/1986 | Yoshida et al. . | |
| 4,724,586 | 2/1988 | Tsubokawa et al. | 24/389 |
| 4,823,446 | 4/1989 | Tsubata et al. | 24/389 |
| 4,888,859 | 12/1989 | Horita . | |
| 4,942,648 | 7/1990 | Yoshida . | |
| 5,003,902 | 4/1991 | Benstock et al. | 112/418 |
| 5,129,127 | 7/1992 | Hamatani . | |

FOREIGN PATENT DOCUMENTS

| | | | |
|---|---|---|---|
| 0796468 | 10/1968 | Canada | 24/389 |
| 0111889 | 6/1984 | European Pat. Off. . | |
| 0238932 | 9/1987 | European Pat. Off. . | |
| 0410292 | 1/1991 | European Pat. Off. . | |
| 607586 | 9/1948 | United Kingdom . | |
| 2046171 | 11/1980 | United Kingdom . | |

*Primary Examiner*—Victor N. Sakran
*Attorney, Agent, or Firm*—David J. Johns

[57] ABSTRACT

An improved water resistant slide fastener and method of producing a water resistant zippered seam is disclosed. A thin and flexible water resistant coating is employed on the inside and outside surfaces of the stringer tapes of the slide fastener to eliminate water penetration therethrough. Once the slide fastener is attached to a garment or other article, a water resistant seam sealing tape employing a compatible adhesive is then installed over the attachment means of the stringer tape to protect further against water penetration. The zipper of the present invention is flexible and comfortable to wear, while being fully effective at preventing unwanted water penetration without the need for costly and cumbersome additional barrier layers.

16 Claims, 3 Drawing Sheets

WATER RESISTANT CLOSURE AND METHOD FOR APPLYING SAME

BACKGROUND OF THE INVENTION

1. Field of the Invention

The present invention relates to slide fastening devices for joining together fabric and similar material. More particularly, the present invention is directed to a slide fastening device for providing a water-resistant seal.

2. Description of Related Art

In recent years there has been significant improvements in the development of water resistant fabrics for a wide variety of applications, such as outdoor clothing, sports equipment, etc. In addition to improved nylon materials with coatings of polyurethane, polyethylene, or similar polymer, a number of more comfortable "breathable" waterproof fabrics have been developed which repel water while permitting the dissipation of water vapor (e.g. perspiration). Methods for creating such a material from polytetrafluoroethylene (PTFE) is disclosed in a number of patents, including U.S. Pat. No. 3,953,566 issued Apr. 27, 1976, to Gore.

With the improvements in imparting waterproofness to fabrics, the seams connecting the fabric material have become the primary location where water penetration tends to occur. This problem is probably most severe at seams connected with resealable closures, such as access zippers, zippered pockets, and underarm "pit-zips" and other openings provided for adjustable ventilation. While these resealable seams are necessary for the proper functioning of the product, they have proven to be particularly difficult to seal properly.

In certain extreme environments, such as on over-water flight suits or life preservers, watertight zippers have been employed for many years. Generally these closures must be made completely waterproof for protection in life threatening situations where a garment or container must be thoroughly watertight and the zippers usually rely on extra barrier layer or layers to seal against any possible water penetration. Among the problems with this approach is that the zippers are very difficult to operate (i.e. usually requiring two hands to open and close), they tend to be far too stiff and unyielding to normal flex-detracting from the "hand" (i.e. the normal texture, drape, bend and feel) of the fabric, and they employ mechanisms which are considered overly complicated and expensive to manufacture for everyday use. Examples of such devices are found in United Kingdom Patent 607,586 issued May 5, 1944, to B.F. Goodrich Company, U.S. Pat. No. 2,532,724 issued Dec. 5, 1950, to Krupp, and European Patent Application 87-103404.7 filed Mar. 10, 1987, by Yoshida Kogyo K.K.

For less demanding environments, a number of attempts have been made to develop a slide fastener which is water resistant yet is somewhat easier to operate. Unfortunately, most of these devices again employ some form of barrier layer to help resist water penetration. In U.S. Pat. No. 4,601,085 issued Jul. 22, 1986, to Yoshida et al. a slide fastener is proposed with a stringer tape (i.e. the material used to attach the zipper elements to the fabric) being made water resistant through one of a variety of methods, including by attaching multiple layers of water sealant material or constructing the entire tape from water proof material. In order to improve water tightness, the patent employs dual rows of offset slide fastener elements (e.g. zipper teeth) with a barrier layer of stringer tape mounted across the opening between them. For further improved water-resistance, the patent suggests using a "double-coupling" construction which actually overlaps the stringer tapes between the slide fastener elements.

Although the approach suggested in the Yoshida et al. patent may help reduce wicking of water through the stringer tape material, it is also deficient in a number of respects. First, those mechanisms taught for imparting waterproofness to the stringer tapes by imposing an intermediate barrier layer within the stringer tapes are considered to be too difficult and costly to be readily implemented. Second, the patent offers only partial solutions of how to avoid the seepage of water through stitched seams holding the slide fastener elements in place. Third, the patent is silent as to how to mount the zipper to avoid leakage through the seams anchoring the stringer tapes to the fabric. Finally, the use of an intermediate barrier layer, and especially the suggested double-coupling construction, would also appear to hinder unrestricted operation of the zipper.

Some of these deficiencies are addressed in U.S. Pat. No. 4,888,859 issued Dec. 26, 1989, to Horita. In this patent a single row of zipper elements is anchored to a stringer tape and then the stringer tape is coated on one side by a waterproof layer. In order to resist water seepage through the slide fastener elements, the teeth are mounted so as to create a barrier layer with the stringer tapes abutting one another in a closed position (necessarily requiring a slider to travel over both the zipper elements and the stringer tapes to open and close).

Although the Horita zipper may avoid a seepage problem through the stitches holding the zipper elements in place, this design is also deficient in a number of respects. First, the patent provides no teaching of how to attach the zipper to fabric or how to avoid seepage through seams which may be used to anchor the stringer tapes in place. This problem is probably exacerbated by the fact that the outer layer of the stringer tapes are not coated and should be susceptible to water wicking through them to mounting seams. Additionally, the abutment of the stringer tapes is again considered to be a restraint on free zipper movement.

In light of these difficulties, the most common method used today for protecting a zippered opening in a water resistant garment is to install a conventional zipper in conjunction with one or more storm flaps or other separate barrier layer. These flaps are attached to a garment so as to cover and/or back the zipper and prevent water from passing through. Outside storm flaps are normally held in place with a series of snaps or hook-and-loop fasteners. Barrier layers of this form have proven quite effective at eliminating water seepage while retaining a fully flexible and comfortable resealable closure.

Unfortunately, storm flaps are far from a panacea. These flaps tend to be quite expensive to manufacture and attach, requiring a significant amount of material and numerous additional mounting steps. Further, such barrier layers restrict ready user access to the zipper and, if not properly constructed, are prone to being caught in the zipper. Moreover, many designers have complained that the use of storm flaps in water-resistant garments is overly bulky, limits the range of design options, and leads to the garments looking far too similar to one another.

Accordingly, it is a primary purpose of the present invention to provide a water-resistant slide closure for a garment or other product and method for making the same which is effective at avoiding water seepage but is fully flexible and comfortable to wear or employ.

It is a further purpose of the present invention to provide such a water-resistant slide closure which does not rely on cumbersome additional barrier layers which add cost and complexity to the product while restricting free access to and movement of the zipper.

It is another purpose of the present invention to provide such a water-resistant slide closure which can be implemented with minimal cost and labor.

These and other purposes of the present invention will become evident from review of the following specification.

SUMMARY OF THE INVENTION

The present invention provides an improved water resistant slide fastening device and a method for making it. The slide fastener of the present invention employs a pair of stringer tapes treated to be water resistant on their inside and outside surfaces and a water resistant seam sealing tape provided with an adhesive coating compatible with the waterproof inside surface of the stringer tapes. Once the stinger tapes are attached to an article of waterproof material through a stitched seam or similar means, the seam sealing tape is then applied over the stringer tapes to seal the stringer tapes from unwanted water penetration.

When so constructed, the slide fastener of the present invention provides an effective water resistant seal without the need for additional barrier layers. Additionally, unlike many existing water resistant zippers, the slide fastener of the present invention is virtually indistinguishable in thickness, flexibility, drape, feel and operation from conventional non-water resistant zippers. This not only provides smooth and unencumbered operation of the zipper itself, but also vastly improves the comfort of wearing the zipper and the range of designs which can incorporate a water resistant zippered seam.

DESCRIPTION OF THE DRAWINGS

The operation of the present invention should become apparent from the following description when considered in conjunction with the accompanying drawings, in which.

DETAILED DESCRIPTION OF THE INVENTION

The present invention is an improved system for providing a water-resistant slide fastener (or "zipper") which can be employed in a variety of applications. The terms slide fastener and zipper are used interchangeably herein and are intended to encompass any form of sliding resealable device, including without limitation those employing teeth, coils or cones as slide fastener elements.

Figure 1:
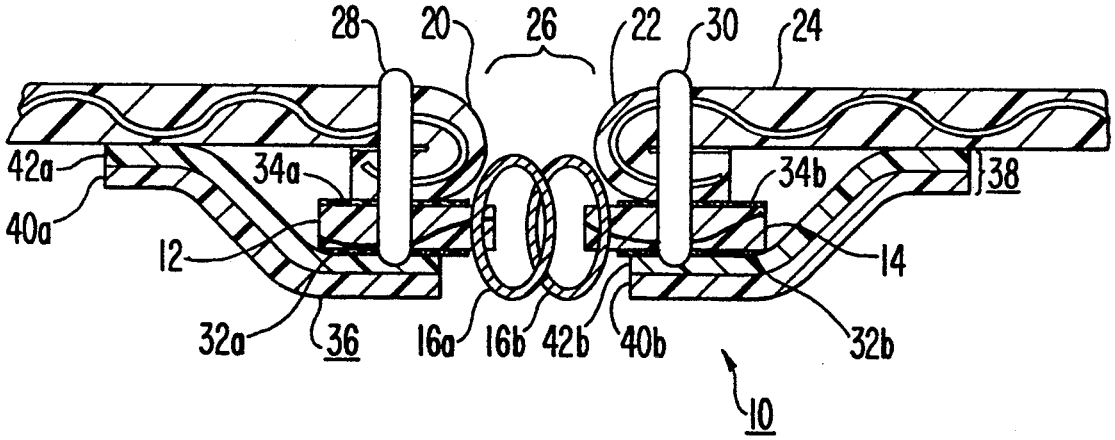
FIG. 1 is a cross-sectional view of one embodiment of a water-resistant closure of the present invention.
Figure 3:
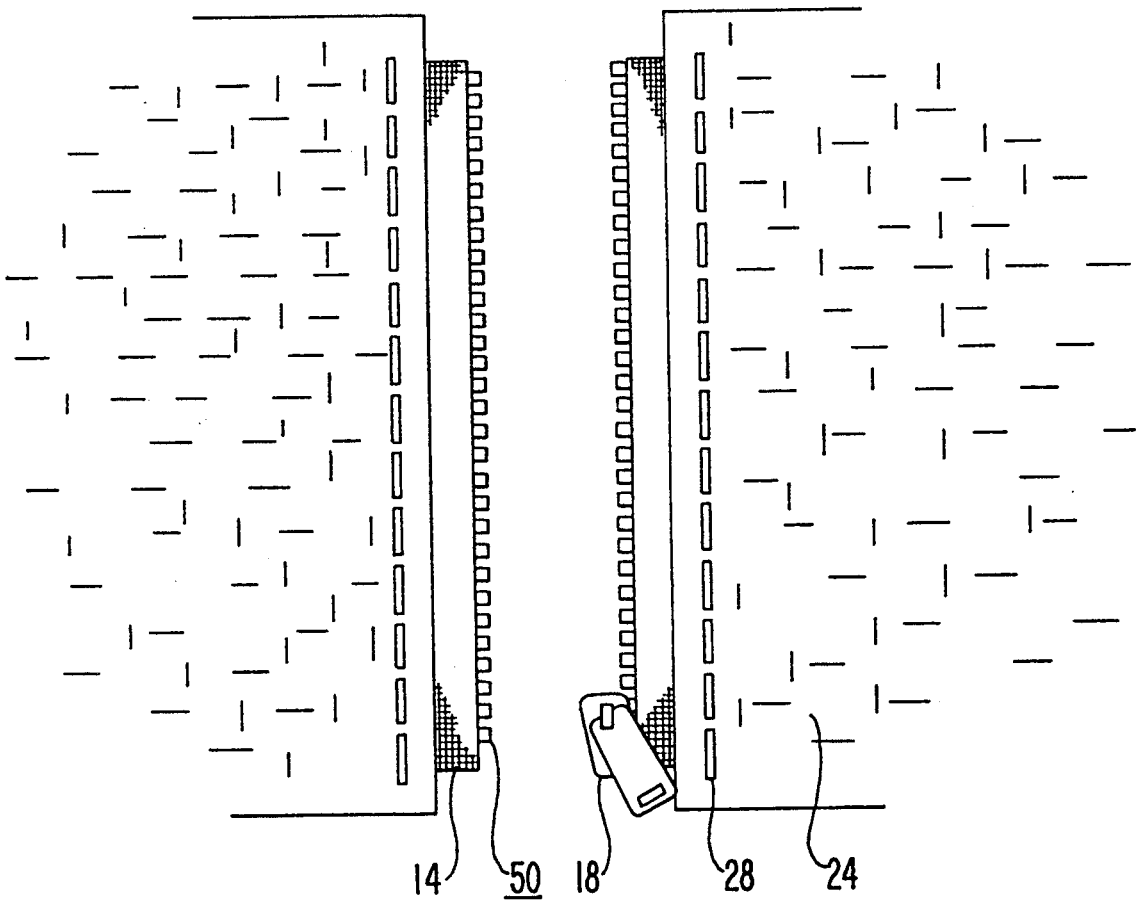
FIG. 3 is a plan view of a separating water resistant closure.
Figure 4:
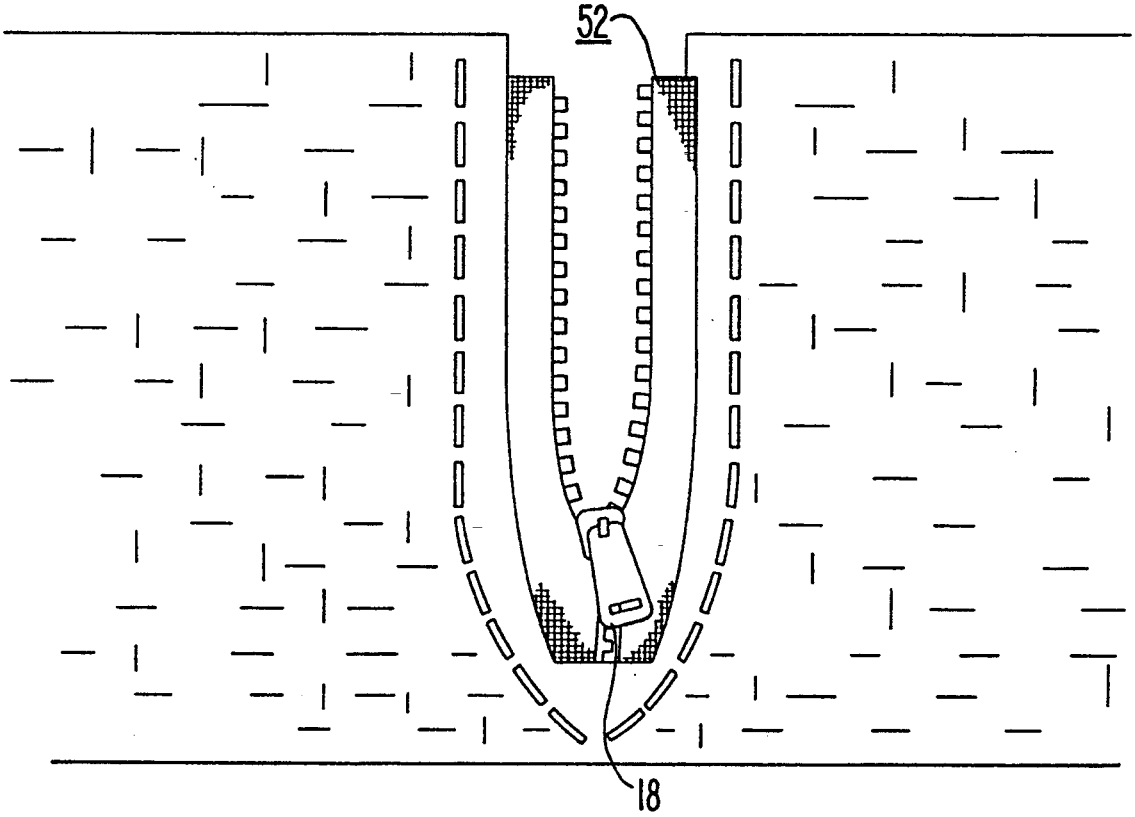
FIG. 4 is a plan view of a non-separating water-resistant closure.

As is illustrated in FIG. 1, the water-resistant slide fastener 10 of the present invention comprises a first stringer tape 12, a second stringer tape 14, and multiple complementary slide fastener elements 16*a*, 16*b* attached to the ends of each of the stringer tapes 12, 14. A conventional slider 18, as shown in FIGS. 3 and 4, is provided which travels along the length of the zipper and connects or separates the zipper in a known manner.

The zipper 10 is attached between two essentially parallel longitudinal edges 20, 22 of fabric 24 to seal an opening 26 therebetween. The zipper 10 is connected through a stitched seam 28, 30 attached between the fabric 24 and each of the stringer tapes 12, 14. Additionally, the stringer tapes 12, 14 can be attached or reinforced through other suitable means, including using adhesives, rivets, etc.

Although previous attempts to produce a water-resistant zipper have centered around preventing water from entering through gaps between zipper teeth or similar elements, applicant has determined that this area is of far less concern than water penetration wicking through the stringer tapes and passing through the holes formed by a stitched seam 28, 30. In fact, with the availability of fine plastic coil zippers and plastic cone and tooth zippers with tighter tolerances, water penetration through the zipper elements 16*a*, 16*b* has become relatively negligible for most applications. For use with the present invention, virtually any zipper with tight connections between the slide fastener elements is considered acceptable. It is preferred to employ a coiled zipper with a gap between the stringer tapes when closed of about 0.5 mm or less. Ideally the entire zipper, including the stringer tapes and the slide fastener elements themselves, should be coated with a durable water repellency finish to assist further in shedding water. For durability, the zipper should be capable of passing appropriate tensile strength tests, such as ASTM Standard D-2061.

The preferred stringer tape 12, 14 is constructed from a flexible material with a "hand" appropriate for the selected fabric 24. Preferably the stringer tapes comprise a cloth material, such as a polyester or a polyester with a PTFE coating.

Accordingly, in order to impart water resistance to the zipper 10 of the present invention, the focus has been on finding both an effective yet flexible and freely bendable means to supply waterproofness and an effective and water-resistant means to attach the zipper to the fabric.

In order to eliminate water penetration through the stringer tapes 12, 14, the present invention provides a thin flexible polymer coating 32*a*, 32*b*, 34*a*, 34*b* on the respective inside and outside surfaces of each of the tapes 12, 14. The coating should resist any water penetration into the stringer tapes and, preferably, should be sufficiently hydrophobic to cause water to bead-up and roll off the tape. As is explained below, the stringer tapes should be coated on two sides both to improve water resistance and to accommodate attachment of a seam sealing tape 36, 38.

Preferably, the polymer coating comprises a layer of a flexible polymer such as polyamide, polyethylene, polyester, polyurethane, natural rubber, nitrile rubber, or butyl rubber. The polymer should be applied in a thin coating on the stringer tapes to avoid detracting from the normal flexibility and bendability of the stringer tape material. For example, the coating may comprise one or more layers of polyurethane 2 to 4 mils thick. The coating may be applied through any suitable means, including by spraying, dip coating, brushing on, or as a film applied with heat, adhesive or other means. For many applications, the coating can be bonded to the material as an adhesive (e.g. as a polyurethane tape). Particularly with regard to a coating of separate material attached with or as an adhesive, care should be exercised to provide sufficient space between the zipper elements 16 and the coating to permit the free movement of the slider 18 (e.g. a gap of 1 to 3 mils should normally be sufficient).

Figure 2:
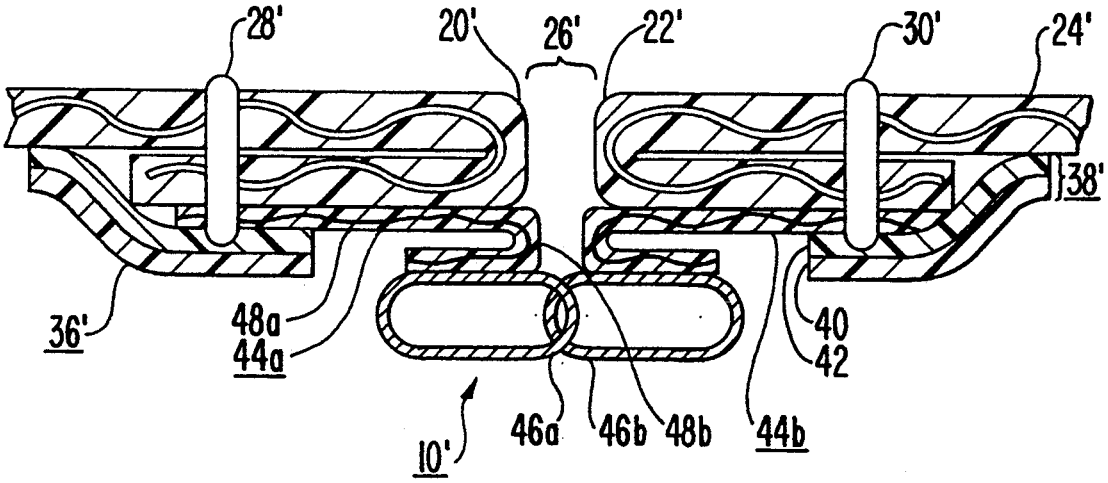
FIG. 2 is a cross-sectional view of another embodiment of a water-resistant closure of the present invention.

As is illustrated in FIGS. 1 and 2, the polymeric coating applied in the present invention is relatively thin and contributes minimal cross-sectional dimension to the stringer tapes. As is shown in FIG. 2 and is explained below, the stringer tapes remain quite flexible despite their water resistant polymeric coating.

The coating of both sides of the stringer tapes 12, 14 accomplishes two important functions. First, the risk of any water seeping through the tape is further diminished by coating both of its surfaces. Second, and more importantly, it has been found that conventional seam sealing tape will not securely seal to many conventional zipper stringer tapes, and especially those tapes made from cloth or certain plastics. In these instances, adhesives in the seam sealing tapes tend to lose their effectiveness over time and with heavy wear, allowing the tape to separate from the stinger and permit water to pass therethrough. The coating of the stringer tapes is performed to avoid these problems.

As is shown, the seam sealing tapes 36, 38 comprise a water resistant sheet 40*a*, 40*b* bonded to an adhesive layer 42*a*, 42*b*. The water resistant sheet 40*a*, 40*b* may be a fabric laminate, microporous polymeric membrane, or similar material. Preferably, the sheet includes a membrane of expanded PTFE or similar water repellant material with a total sheet thickness of approximately 1.5 mil. Such a product can be produced in a known manner, such as in accordance with the teachings of U.S. Pat. No. 3,953,566 to Gore. The adhesive layer comprises a thermoplastic polymeric adhesive, and preferably is a layer of polyurethane or similar material with a thickness of no more than approximately 4.0 to 6.0 mils. The sealing tape should have an overall thickness of 1.0 to 6.0 mil, with 4.0 to 6.0 mil being preferred.

One of the most important parameters of the present invention is to assure that the inside coating 32*a*, 32*b* on the stringer tapes 12, 14 is adhesively compatible to the adhesive layer 42*a*, 42*b* on the sealing tape 36, 38. As has been explained, a serious source of water penetration emerges if the sealing tape begins to separate from the stringer tapes. The following table summarizes some compatibilities which function in this regard:

| Stringer Tape Coating | Seam Tape Adhesive |
|---|---|
| Polyurethane (PU) | PU |
| PTFE | Polyvinyl Chloride (PVC) or PU |
| Polyester | Polyester |
| Fluorinated ethylene-propylene (FEP) | FEP |

For most applications, the preferred combination is that of polyurethane coating in contact to a polyurethane adhesive. The polyurethane may be either a breathable or non-breathable form. It has been found that rubber can be used as a stringer tape coating but it may require a further coating thereon (e.g. of polyurethane or similar polymer) before it will adequately bond to a seam tape adhesive.

As is shown in FIG. 2, the present invention may be incorporated into a variety of zipper applications. In this embodiment, the stringer tapes 44*a*, 44*b* are folded back on themselves so that the tapes cover at least in part the slide fastener elements 46*a*, 46*b*. In this form of construction the zipper is partially hidden from view while the stinger tapes serve to limit direct access of water to the area between the slide fastener elements 46*a*, 46*b*. As should be evident, it is particularly important that the waterproof coatings 48*a*, 48*b* on each side of each of the stringer tapes is thin and flexible in order to allow tapes to be folded in the manner shown. Again, each of the stringer tapes 48*a*, 48*b* is held in place with one or more stitched seams 28', 30'. The seams are then sealed with seam sealing tape 36', 38' in the manner previously described.

The embodiment FIG. 2 provides a number of advantages over the embodiment of FIG. 1. For instance, in addition to limiting water entrance through zipper elements 46*a*, 46*b*, this embodiment provides a smaller opening 26' between edges 20' and 22'. Although, the slide fastener 18 must travel over both the zipper 10' and the fabric material 24' in this embodiment, which may provide slight impediment to zipper movement, any resistance caused by such an arrangement is far less than the encumbered operation normally experienced with presently available waterproof zippers.

Additionally, as is shown in FIGS. 3 and 4, the present invention can be readily adapted to open-ended, separable zippers 50, as are normally applied to provide access to garments, and to non-separable, close-ended zippers 52, as are normally applied to seal pockets or as "pit-zips."

Figure 5:
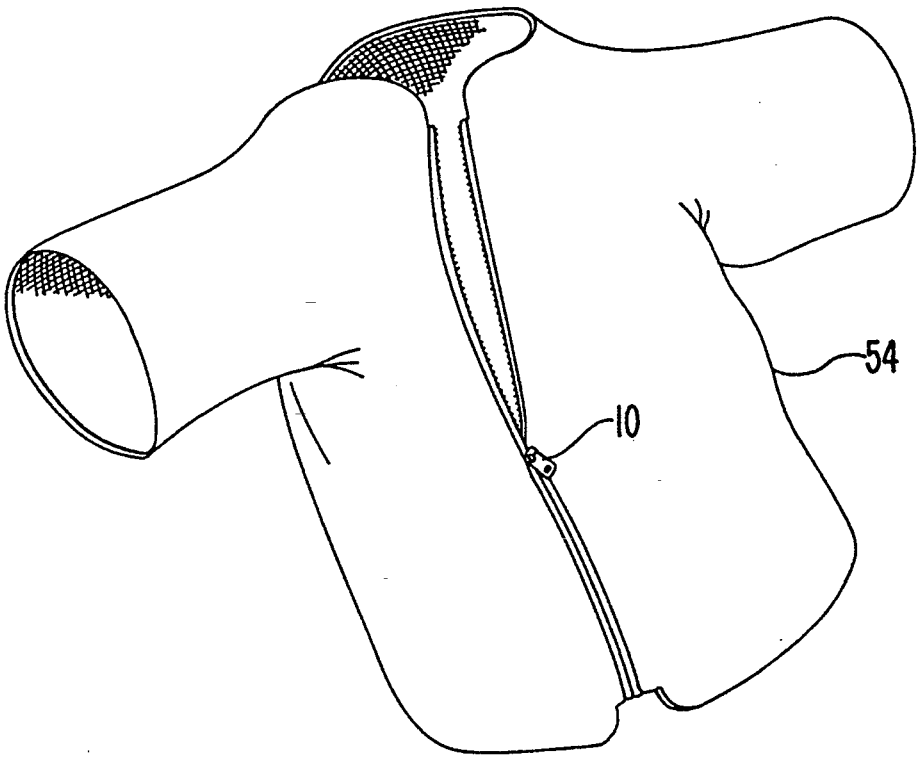
FIG. 5 is a plan view of a garment containing a water-resistant closure of the present invention.

The zippers of the present invention can be installed in virtually any article, including in coats, pants, gloves, hats, boots, shoes, socks, tents, sleeping bags, luggage, etc. One such application is illustrated in FIG. 5, where the zipper 10 is installed as an access zipper in a shirt 54.

The slide fastener of the present invention provides an effective water resistant seal without the need for additional barrier layers. Additionally, unlike many existing water resistant zippers, the slide fastener of the present invention is virtually indistinguishable in thickness and "hand" (e.g. flexibility, drape, feel) from conventional non-water resistant zippers. This not only provides smooth and unencumbered operation of the zipper itself, but also vastly improves the comfort of wearing the zipper and the range of designs which can incorporate a water resistant zippered seam.

Moreover, by eliminating the need for additional barrier layers, the present invention vastly decreases the labor and material costs presently inherent in the production of waterproof zippered seams. Although additional barrier layers can still be provided with the present invention for additional protection, it has been found that such layers are not required to have a highly effective water resistant zippered seam.

Without intending to limit the scope of the present invention, the apparatus and method of production of the present invention may be better understood by referring to the following examples

EXAMPLES

Example 1

A water-resistant closure of the instant invention was produced in the following manner.

A separating slide fastener was obtained. The slide fastening device had polymeric coils attached to polyester fabric stringer tapes and was 66 cm in length. The stringer tapes were subsequently coated on both sides with a 0.2 mm thick thermoplastic polyurethane tape that had been cut to match the length and width of the stringer tapes. Care was taken so that the polymeric coils would be free of the thermoplastic polyurethane tapes thereby allowing the slide fastening device to operate smoothly.

The thermoplastic polyurethane tapes were melted into the stringer tapes by covering the stringer tapes with release paper and placing the stringer tapes in a sealing press heated to 191° C. for 15 seconds with sufficient pressure to force the thermoplastic polyurethane into the fabric of the stringer tapes. Care was taken to apply heat and pressure only to the stringer tapes and not to the polymeric coils contained thereon so as not to deform the polymeric coils.

The slide fastening device was removed from the sealing press and the thermoplastic polymeric tapes were allowed to cool before the release paper was stripped from the surface of the thermoplastic polyurethane tapes.

The slide fastening device was inserted into a front opening of a jacket made from a waterproof laminate containing a polyester fabric layer laminated to a waterproof layer (e.g. GORE-TEX® laminate available from W. L. Gore & Associates, Inc., Elkton, Md.). The slide fastening device was sewn into the jacket using a cotton-covered polyester thread at 3–4 stitches per cm. Subsequently, the stitches were sealed using a 0.2 mm thick thermoplastic polyurethane seam sealing tape (e.g. GORE-SEAM® tape available from W. L. Gore & Associates, Inc., Elkton, Md.). The thermoplastic polyurethane seam sealing tape was arranged so that the thermoplastic polyurethane seam sealing tape covered the stitches found in the stringer tape and a portion of the inside surface of the fabric laminate. Heat and pressure was used to melt and seal the thermoplastic polyurethane seam sealing tape to the stringer tape and to the inside surface of the fabric laminate.

To test the water resistance of the closure, the finished jacket was placed on a mannequin, and the slide fastening device was closed as in actual use. A plastic bag was placed over the head of the mannequin and was sealed over the collar of the jacket so water would not enter the jacket through the head opening.

Water was sprayed upon the jacket from an overhead nozzle to simulate a rainfall of approximately 7.6 cm/hr. The duration of the water spray was thirty minutes. Upon termination of the water spray, the inside surface of the jacket was carefully inspected for the presence of water penetration. No water was found within the jacket.

Example 2

A slide fastener as in Example 1 was obtained. Both surfaces of the stringer tapes were coated by carefully brushing by hand an amount of molten thermoplastic polyurethane onto the surfaces. The molten thermoplastic polyurethane was allowed to cool and solidify.

The slide fastener, containing the coatings of thermoplastic polyurethane was attached and sealed to a jacket as in Example 1.

The jacket was tested by the method as described in Example 1 for thirty minutes. No water was found within the jacket.

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A slide fastener for providing a water resistant closure between two parallel longitudinal edges defining an opening in waterproof fabric which comprises a pair of stringer tapes, each having an inside surface and an outside surface, a row of cooperating slide fastener elements mounted on each of the stringer tapes, and a slider cooperating with the fastener elements on the stringer tapes to open and close the slide fastener;

a thin and flexible water resistant polymeric coating on both the inside and outside surfaces of the stringer tapes, the coating selected from the group consisting of polyamide, polyethylene, polyester, polyurethane, natural rubber, nitrile rubber, and butyl rubber;

a stitched seam to assist in attaching each of the stringer tapes to one of the longitudinal edges of the fabric; and a water resistant sealing tape covering the stitched seam and a portion of the stringer tapes having the polymeric coating thereon, the sealing tape including an adhesive coating to secure it to the stringer tape, and wherein the adhesive coating is adhesively compatible with the polymeric coating on the stringer tape;

wherein the polymeric coating and sealing tape are positioned to permit smooth and unencumbered operation of the slide fastener; and wherein an effective water resistant seal is formed between the edges of the fabric without the need for an additional barrier layer covering the opening.

2. The slide fastener of claim 1 wherein the stringer tapes are folded back on themselves so as to cover the slide fastener elements at least in part.

3. The slide fastener of claim 1 wherein the polymeric coating comprises polyurethane.

4. The slide fastener of claim 3 wherein the sealing tape comprises a waterproof substrate with a polyurethane adhesive applied thereto.

5. The slide fastener of claim 4 wherein the waterproof substrate includes a layer of polytetrafluoroethylene.

6. The slide fastener of claim 5 wherein the sealing tape comprises a seam tape of polytetrafluoroethylene and polyurethane adhesive with a total thickness of substantially between 1 and 6 mils.

7. The slide fastener of claim 6 wherein each of the polymeric coatings comprises a layer of polyurethane polymer with a thickness of substantially between 2 and 4 mils.

8. The slide fastener of claim 7 wherein the cooperating slide fastener elements comprise a coil.

9. A method of creating a water resistant closure for an opening in water resistant fabric which comprises:

providing a water resistant fabric having an opening therein comprising two substantially parallel longitudinal edges;

providing a zipper comprising a pair of stringer tapes, each having an inside surface and an outside surface, a row of cooperating slide fastener elements mounted on each of the stringer tapes, and a slider cooperating with the fastener elements on the stringer tapes to open and close the slide fastener;

furnishing the stringer tapes with inside and outside surfaces which repel water while remaining relatively thin and flexible, the surfaces made water repellent by a thin polymeric coating selected from the group consisting of polyamide, polyethylene, polyester, polyurethane, natural rubber, nitrile rubber, and butyl rubber;

attaching each of the stringer tapes to one of the longitudinal edges of the fabric at least in part through the use of a stitched seam;

covering the stitched seam and a portion of the stringer tape with a thin and flexible waterproof sealing tape, the sealing tape being provided with an adhesive coating which is compatible with the water repellent surface on the covered portion of the stringer tape;

wherein the closure is flexible and does not detract from the normal hand of the fabric, and the slider travels freely along the length of the zipper with minimal resistance to movement; and wherein an effective water resistant seal is formed between the edges of the fabric which does not require an additional barrier layer covering the opening.

10. The method of claim 9 which further comprises employing a waterproof polymer of polyurethane and employing a polyurethane adhesive for the sealing tape.

11. The method of claim 9 which further comprises treating the stringer tapes to be waterproof by applying a thin polymeric coating on each stringer tape's inside and outside surfaces;

providing a sealing tape comprising a polytetrafluoroethylene (PTFE) material with a polymeric adhesive applied to it, wherein the polymeric adhesive is compatible with the polymeric coating.

12. The method of claim 11 which further comprises providing a polymeric coating comprising a polyurethane and providing a polymeric adhesive comprising a polyurethane.

13. The method of claim 9 which further comprises folding the stringer tapes back on themselves so as to cover the slide fastener elements at least in part.

14. The method of claim 13 which further comprises treating the stringer tapes to be waterproof by applying a thin polymeric coating on each stringer tape's inside and outside surfaces.

15. The method of claim 9 which further comprises providing inside and outside surfaces of the stringer tapes which include a polytetrafluoroethylene material to assist in repelling water.

16. The method of claim 10 which further comprises positioning the polymeric coating and the sealing tape sufficiently away from the slide fastener elements to permit the unimpeded movement of the slider.

* * * * *